US009366438B2

(12) United States Patent
Rajaram et al.

(10) Patent No.: US 9,366,438 B2
(45) Date of Patent: Jun. 14, 2016

(54) FLOW SLEEVE INLET ASSEMBLY IN A GAS TURBINE ENGINE

(71) Applicants: Rajesh Rajaram, Oviedo, FL (US); Juan Enrique Portillo Bilbao, Oviedo, FL (US); Danning You, Shanghai (CN)

(72) Inventors: Rajesh Rajaram, Oviedo, FL (US); Juan Enrique Portillo Bilbao, Oviedo, FL (US); Danning You, Shanghai (CN)

(73) Assignee: SIEMENS AKTIENGESELLSCHAFT, München (DE)

( * ) Notice: Subject to any disclaimer, the term of this patent is extended or adjusted under 35 U.S.C. 154(b) by 643 days.

(21) Appl. No.: 13/767,123

(22) Filed: Feb. 14, 2013

(65) Prior Publication Data

US 2014/0223914 A1 Aug. 14, 2014

(51) Int. Cl.

| | |
|---|---|
| ***F23R 3/26*** | (2006.01) |
| ***F23R 3/10*** | (2006.01) |
| ***F23R 3/46*** | (2006.01) |
| ***F23R 3/54*** | (2006.01) |

(52) U.S. Cl.

CPC ... *F23R 3/26* (2013.01); *F23R 3/10* (2013.01); *F23R 3/46* (2013.01); *F23R 3/54* (2013.01); *F23R 2900/00014* (2013.01); *F23R 2900/03043* (2013.01)

(58) Field of Classification Search

CPC ..... F23R 3/26; F23R 3/10; F23R 3/46; F23R 3/54; F23R 2900/00014; F23R 2900/03043

See application file for complete search history.

(56) References Cited

U.S. PATENT DOCUMENTS

| | | | | |
|---|---|---|---|---|
| 2,610,467 | A | 9/1952 | Miller | |
| 3,169,367 | A * | 2/1965 | Hussey | F23R 3/04 60/39.37 |
| 3,349,558 | A | 10/1967 | Smith | |
| 3,542,152 | A | 11/1970 | Adamson et al. | |
| 3,702,058 | A * | 11/1972 | De Corso | F23R 3/08 60/39.37 |
| 3,726,087 | A | 4/1973 | Bryce | |
| 3,948,346 | A | 4/1976 | Schindler | |
| 4,050,238 | A * | 9/1977 | Holzapfel | F23R 3/30 431/116 |
| 4,109,459 | A | 8/1978 | Ekstedt et al. | |
| 4,122,674 | A * | 10/1978 | Andersson | F02C 7/24 431/114 |
| 4,137,992 | A | 2/1979 | Herman | |
| 4,199,936 | A | 4/1980 | Cowan et al. | |
| 6,594,999 | B2 * | 7/2003 | Mandai | F23R 3/26 60/722 |
| 6,688,107 | B2 | 2/2004 | Ono et al. | |
| 6,907,736 | B2 * | 6/2005 | Ohnishi | F23R 3/002 60/725 |
| 7,540,153 | B2 * | 6/2009 | Tanimura | F23R 3/04 60/737 |
| 7,594,401 | B1 | 9/2009 | Chen et al. | |
| 7,908,867 | B2 | 3/2011 | Keller et al. | |

(Continued)

FOREIGN PATENT DOCUMENTS

| | | |
|---|---|---|
| EP | 2375161 A2 | 10/2011 |
| EP | 2484978 A2 | 8/2012 |

*Primary Examiner* — Carlos A Rivera

(57) ABSTRACT

A combustor assembly in a gas turbine engine includes a liner defining a combustion zone, at least one fuel injector for providing fuel, and a flow sleeve. An inner surface of the flow sleeve defines an outer boundary for an air flow passageway. Upon the air reaching a head end of the combustor assembly at an end of the air flow passageway the air turns 180 degrees to flow into the combustion zone where it is burned with the fuel. The combustor assembly further includes an inlet assembly positioned radially between the liner and the flow sleeve. The inlet assembly defines an inlet to the air flow passageway and includes a plurality of overlapping conduits that are arranged such that the air entering the air flow passageway passes through radial spaces between adjacent conduits.

18 Claims, 4 Drawing Sheets

(56) References Cited

U.S. PATENT DOCUMENTS

2010/0005804 A1 1/2010 Chen et al.
2011/0005233 A1* 1/2011 Sadig ..... F23R 3/04 60/754
2011/0214429 A1* 9/2011 Chen ..... F23R 3/005 60/755
2011/0247339 A1* 10/2011 Chila ..... F23R 3/02 60/752
2012/0198855 A1* 8/2012 Cihlar ..... F01D 9/023 60/760
2013/0167543 A1* 7/2013 McMahan ..... F01D 9/023 60/752
2014/0090400 A1* 4/2014 Stuttaford ..... F23R 3/16 60/796

* cited by examiner

FLOW SLEEVE INLET ASSEMBLY IN A GAS TURBINE ENGINE

FIELD OF THE INVENTION

The present invention relates to an inlet assembly associated with a flow sleeve in a gas turbine engine, and, more particularly, to an inlet assembly including a plurality of overlapping conduits that are arranged such that air entering an air flow passageway defined by the flow sleeve passes through radial spaces between adjacent conduits.

BACKGROUND OF THE INVENTION

During operation of a gas turbine engine, air is pressurized in a compressor section then mixed with fuel and burned in a combustion section to generate hot combustion gases. In a can annular gas turbine engine, the combustion section comprises an annular array of combustor apparatuses, sometimes referred to as "cans", which each supply hot combustion gases to a turbine section of the engine where the hot combustion gases are expanded to extract energy from the combustion gases to provide output power used to produce electricity.

SUMMARY OF THE INVENTION

In accordance with a first aspect of the present invention, a combustor assembly is provided in a gas turbine engine. The combustor assembly comprises a liner defining a combustion zone where fuel and air are mixed and burned to create a hot working gas that flows through the combustion zone generally in a first direction toward a turbine section of the engine, at least one fuel injector for providing the fuel to be burned in the combustion zone, and a flow sleeve located radially outwardly from the liner. An inner surface of the flow sleeve defines an outer boundary for an air flow passageway where the air to be burned in the combustion zone flows generally in a second direction opposite to the first direction. Upon the air reaching a head end of the combustor assembly at an end of the air flow passageway the air turns 180 degrees to flow generally in the first direction into the combustion zone where it is burned with the fuel. The combustor assembly further comprises an inlet assembly positioned radially between the liner and the flow sleeve. The inlet assembly defines an inlet to the air flow passageway and comprises a plurality of overlapping conduits that are arranged such that the air entering the air flow passageway passes through radial spaces between adjacent conduits.

In accordance with a second aspect of the present invention, a combustor assembly is provided in a gas turbine engine. The combustor assembly comprises a liner defining a combustion zone where fuel and air are mixed and burned to create a hot working gas that flows through the combustion zone generally in a first direction toward a turbine section of the engine, at least one fuel injector for providing the fuel to be burned in the combustion zone, and a flow sleeve located radially outwardly from the liner. An inner surface of the flow sleeve defines an outer boundary for an air flow passageway where the air to be burned in the combustion zone flows generally in a second direction opposite to the first direction. Upon the air reaching a head end of the combustor assembly at an end of the air flow passageway the air turns 180 degrees to flow generally in the first direction into the combustion zone where it is burned with the fuel. The combustor assembly further comprises an inlet assembly positioned radially between the liner and the flow sleeve. The inlet assembly defines an inlet to the air flow passageway and comprises a plurality of overlapping concentric conduits that are coupled together and are arranged such that the air entering the air flow passageway passes through radial spaces between adjacent conduits.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

As will be discussed in detail herein, the fine tuning of acoustic losses within a combustor assembly provided by the present invention is believed to increase an operating envelope of a gas turbine engine, which may allow the engine to operate at conditions that provide lower emissions. That is, acoustic losses that result within the combustor assembly, if unable to be modified, e.g., by the present invention, may prohibit certain engine operating conditions due to large pressure oscillations within the combustor assembly, which operating conditions may be capable of producing lower emissions. However, such operating conditions are able to be implemented with the use of the present invention. Further, localized cooling of combustor assembly components located in and around an air flow passageway associated with a flow sleeve of each combustor assembly is able to be provided by embodiments of the present invention, which will now be described.

Figure 1:
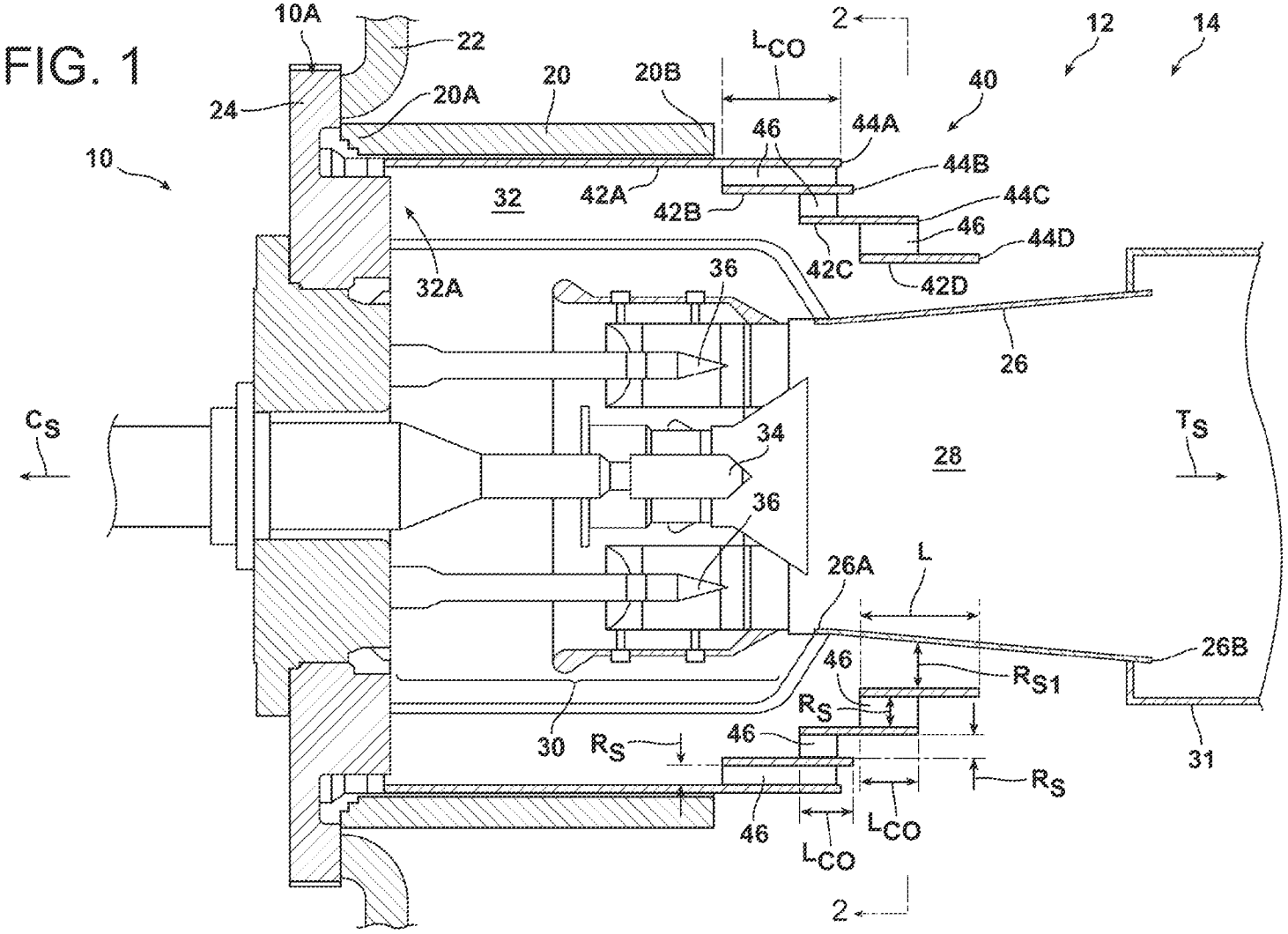
FIG. 1 is a schematic illustration of a portion of a combustion section in a gas turbine engine showing an inlet assembly associated with a flow sleeve in accordance with an aspect of the invention.

Referring to FIG. 1, a combustor assembly 10 for use in a combustion section 12 of a gas turbine engine 14 is shown. The combustor assembly 10 illustrated in FIG. 1 may form part of a can-annular combustion section 12, which may comprise an annular array of combustor assemblies 10 similar to the one illustrated in FIG. 1 and described herein. The engine 14 may generally be of the type described in U.S. Patent Application Publication No. 2010/0071377 published Mar. 25, 2010 to Timothy A. Fox et al., the entire disclosure of which is hereby incorporated by reference herein.

The combustor assembly 10 is provided to burn fuel and compressed air from a compressor section $C_S$ (the general location of the compressor section $C_S$ relative to the combustion section 12 is shown in FIG. 1) to create a hot working gas that is provided to a turbine section $T_S$ (the general location of the turbine section $T_S$ relative to the combustion section 12 is shown in FIG. 1) where the working gas is expanded to provide rotation of a turbine rotor (not shown) and to provide output power, which may be used to produce electricity.

The combustor assembly 10 illustrated in FIG. 1 comprises a flow sleeve 20 coupled to an engine casing 22 via a cover plate 24, a liner 26 that defines a combustion zone 28 where the fuel and compressed air are mixed and burned to create the hot working gas, a transition duct 31 coupled to the liner 26 for delivering the hot working gas to the turbine section $T_S$, and a fuel injection system 30 that is provided to deliver fuel into the combustion zone 28.

The flow sleeve 20 in the embodiment shown comprises a generally cylindrical member that defines an outer boundary for an air flow passageway 32 through which the compressed air to be delivered into the combustion zone 28 flows. As shown in FIG. 1, the flow sleeve 20 is located radially outwardly from the liner 26 such that the air flow passageway 32 is defined radially between the flow sleeve 20 and the liner 26. The flow sleeve includes a first end 20A affixed to the cover plate 24 at a head end 10A of the combustor assembly 10 and a second end 20B, also referred to herein as an axial end, distal from the first end 20A.

In the illustrated embodiment, the fuel injection system 30 comprises a central pilot fuel injector 34 and an annular array of main fuel injectors 36 disposed about the pilot fuel injector 34. However, the fuel injection system 30 could include other configurations without departing from the spirit and scope of the invention. The pilot fuel injector 34 and the main fuel injectors 36 each deliver fuel into the combustion zone 28 during operation of the engine 14.

Figure 2:
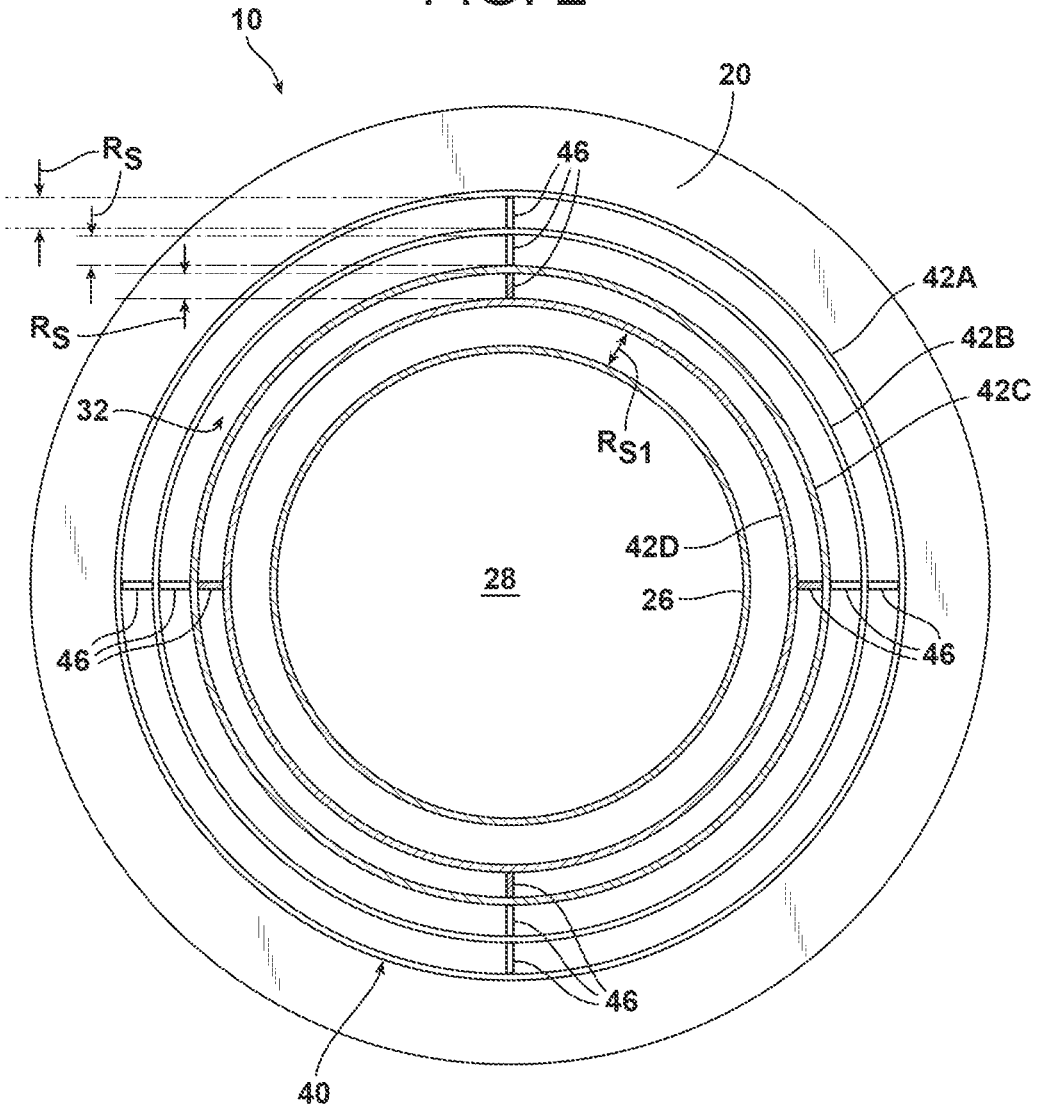
FIG. 2 is a schematic cross sectional view of the inlet assembly taken along line 2-2 in FIG. 1.

Referring additionally to FIG. 2 (it is noted that select components, including the fuel injection system 30, have been removed from FIG. 2 for clarity), the combustor assembly 10 according to this embodiment further comprises an inlet assembly 40 positioned radially between the liner 26 and the flow sleeve 20. The inlet assembly 40 defines an inlet to the air flow passageway 32 and comprises a plurality of overlapping conduits, illustrated in FIGS. 1 and 2 as first through fourth conduits 42A-D, that are arranged such that the air entering the air flow passageway 32 passes through radial spaces $R_S$ between adjacent conduits 42A-D. It is noted that the space between the liner 26 and the fourth conduit 42D may define an additional space $R_{S1}$ for allowing air entry into the air flow passageway 32.

As shown in FIG. 1, the conduits 42A-D are arranged in an axially staggered pattern such that an axial end 44A-D of each conduit 42A-D extends further axially toward the turbine section $T_S$ than the axial end 44A-D of each radially outward adjacent conduit 42A-D. That is, starting from the first conduit 42A, i.e., the radially outermost conduit, and progressing to the fourth conduit 42D, i.e., the radially innermost conduit, the axial end 44A-D of each conduit 42A-D is progressively located closer to the turbine section $T_S$ than the axial end 44A-D of the previous (radially outward) conduit 42A-D. The axial end 44A-D of each conduit 42A-D according to this embodiment also extends further toward the turbine section $T_S$ than the axial end 20B of the flow sleeve 20. Further, the entire fourth conduit 42D, i.e., the radially innermost conduit, according to this embodiment is located directly radially outwardly from the liner 26. That is, a length L of the fourth conduit 42D, which length L is defined between opposing ends of the fourth conduit 42D, is located between an upstream end 26A of the liner 26 and a downstream end 26B of the liner 26, which is coupled to the transition duct 31 as shown in FIG. 1.

Figure 3:
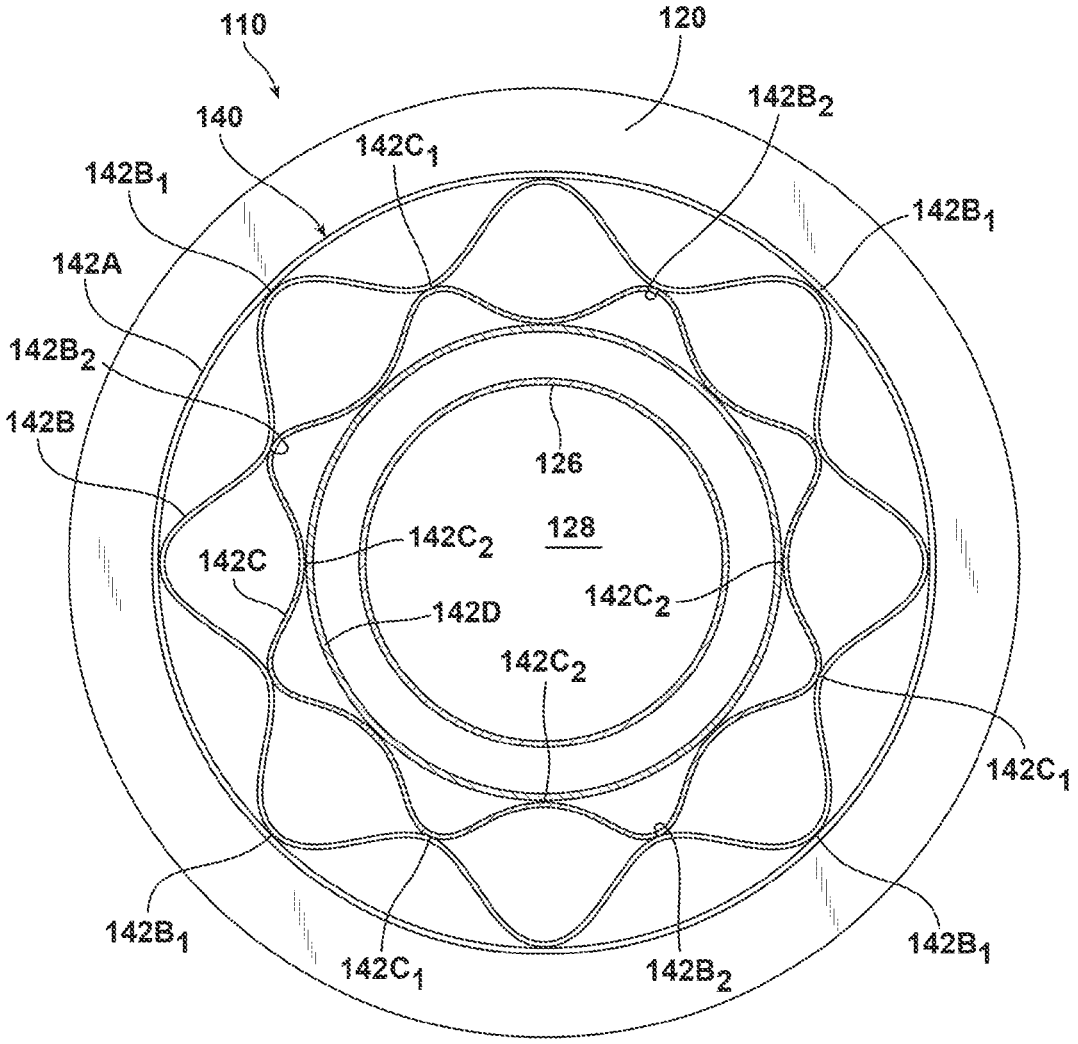
FIG. 3 is a schematic cross sectional view of an inlet assembly that could be used in the place of the inlet assembly illustrated in FIG. 2 in accordance with another embodiment of the invention.

Referring to FIG. 2, the conduits 42A-D according to this embodiment are concentric with one another and are coupled together via a plurality of radial struts 46 that span between the conduits 42A-D. It is noted that other configurations may be provided to effect coupling of the conduits 42A-D together, an example of which is illustrated in FIG. 3 and will be discussed below. It is also noted that the radial struts 46 illustrated in FIGS. 1 and 2 are exemplary and the struts 46 could have any configuration and could be located in any suitable location for coupling the conduits 42A-D together.

During operation of the engine 14, compressed air from the compressor section $C_S$ enters the air flow passageway 32 through the radial spaces $R_S$ defined between the conduits 42A-D of the inlet assembly 40 and through the additional space $R_{S1}$ between the fourth conduit 42D and the liner 26. Forcing the air to pass through the inlet assembly 40 on its way to the air flow passageway 32 is believed to effect a modification of acoustic losses that result at the inlet of the air flow passageway 32 caused by entry of the compressed into the air flow passageway 32, i.e., by changing acoustic boundary conditions at the inlet to the air flow passageway 32.

That is, according to an aspect of the present invention, one or more of the number of conduits 42A-D, which is preferably at least three, their lengths L, radial heights of the radial spaces $R_S$ between adjacent conduits 42A-D, and lengths of conduit overlap $L_{CO}$) (see FIG. 1) may be selected to fine tune acoustic losses provided by the inlet assembly 40. For example, changing any one or more of the number of conduits 42A-D, their lengths L, the radial heights of the radial spaces $R_S$ between adjacent conduits 42A-D, and the lengths of conduit overlap $L_{CO}$ will result in a corresponding change in the characteristics of longitudinal standing acoustic waves that exist within the combustor assembly 10. Hence, the characteristics of these longitudinal standing acoustic waves can be modified as desired by changing the configuration of the inlet assembly 40.

As mentioned above, the fine tuning of acoustic losses within the combustor assembly 10 that result from entry of the compressed into the air flow passageway 32 through the inlet assembly 40 is believed increase the operating envelope of the engine 14, which may allow the engine 14 to operate at conditions that provide lower emissions. That is, acoustic losses that result within the combustor assembly 10 from entry of the compressed into the air flow passageway 32, if unable to be modified, e.g., by the inlet assembly 40 according to the present invention, may prohibit certain engine operating conditions due to large pressure oscillations within the combustor assembly 10, which operating conditions may be capable of producing lower emissions.

Once the compressed air enters the air flow passageway 32 through the inlet assembly 40, the air flows through the air flow passageway 32 in a direction away from the second end 20B of the flow sleeve 20 toward the head end 10A of the combustor assembly 10, i.e., away from the turbine section $T_S$ and toward the compressor section $C_S$, which direction is also referred to herein as a second direction. Upon the air reaching the head end 10A of the combustor assembly 10 at an end 32A of the air flow passageway 32, the air turns generally 180 degrees to flow into the combustion zone 28 in a direction away from the head end 10A of the combustor assembly 10 toward the turbine section $T_S$ and away from the compressor section $C_S$, which direction is also referred to herein as a first direction and is opposite to the second direction. The air is mixed with fuel provided by the fuel injection system 30 and burned to create a hot working gas as described above.

Referring now to FIG. 3, an inlet assembly 140 according to another embodiment of the invention is illustrated, where structure similar to that described above with reference to FIGS. 1-2 includes the same reference number increased by 100. It is noted that only select components of the combustor assembly 110 are illustrated in FIG. 3 for clarity.

As shown in FIG. 3, the second and third conduits 142B, 142C are concentric with one another and with the first and fourth conduits 142A, 142D and are corrugated. The corrugations of the second and third conduits 142B, 142C form respective outer peaks 142$B_1$, 142$C_1$ and inner peaks 142$B_2$, 142$C_2$. The outer peaks 142$B_1$ of the second conduit 142B contact the adjacent radially outer conduit, i.e., the first conduit 142A, and the inner peaks 142$B_2$ of the second conduit 142B contact the adjacent radially inner conduit, i.e., the third conduit 142C. Similarly, the outer peaks 142$C_1$ of the third conduit 142C contact the adjacent radially outer conduit, i.e., the second conduit 142B, and the inner peaks 142$C_2$ of the third conduit 142C contact the adjacent radially inner conduit, i.e., the fourth conduit 142D. The contact between the outer and inner peaks 142$B_1$, 142$C_1$, 142$B_2$, 142$C_2$ and the adjacent conduits 142A-D provides structural coupling between the conduits 142A-D according to this embodiment. It is noted that while only the second and third conduits 142B, 142C are corrugated in the embodiment shown, other ones of the conduits 142A, 142D could be corrugated in addition to or instead of the conduits 142B, 142C without departing from the spirit and scope of the invention, as long as structural coupling between the conduits 142A-D is provided in some manner.

Figure 4:
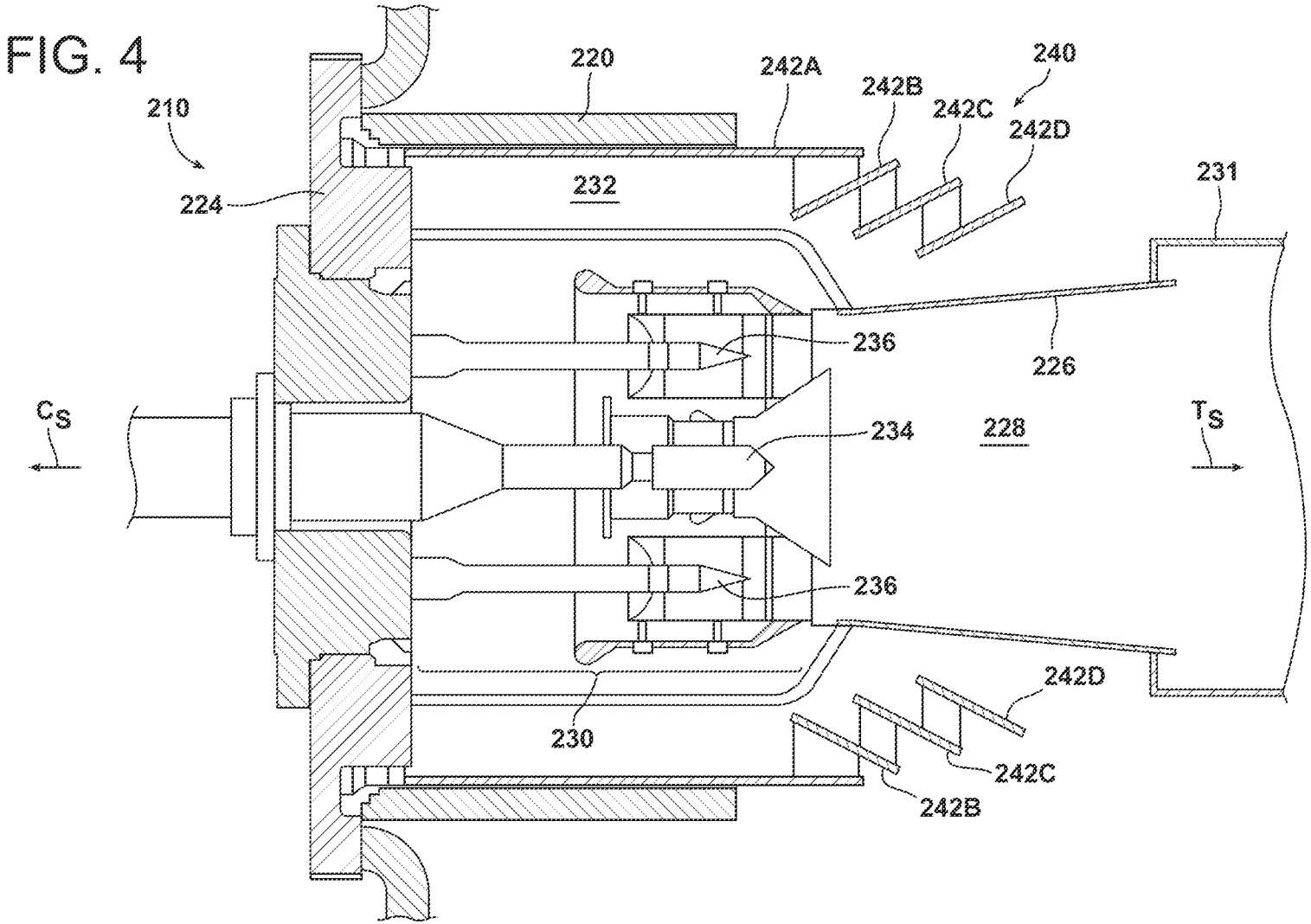
FIG. 4 is a schematic illustration of a portion of an inlet assembly in accordance with yet another embodiment of the invention.

Referring now to FIG. 4, an inlet assembly 240 according to another embodiment of the invention is illustrated, where structure similar to that described above with reference to FIGS. 1-2 includes the same reference number increased by 200. It is noted that only components of the combustor assembly 210 that are different than those of the combustor assembly 10 described above with reference to FIGS. 1-2 will be described herein for FIG. 4.

According to this embodiment, the second, third, and fourth conduits 242B-D are angled in a direction away from the flow sleeve 220 as they extend axially away from the turbine section $T_S$ and toward the compressor section $C_S$, such that the air flowing through the inlet assembly 240 flows in a direction having a radially inward component. The angling of these conduits 242B-D provides localized cooling for combustor assembly components located in and around the air flow passageway 232.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor assembly in a gas turbine engine comprising:

a liner defining a combustion zone where fuel and air are mixed and burned to create a hot working gas that flows through the combustion zone generally in a first direction toward a turbine section of the engine;

at least one fuel injector for providing the fuel to be burned in the combustion zone;

a flow sleeve located radially outwardly from the liner, wherein an inner surface of the flow sleeve defines an outer boundary for an air flow passageway where the air to be burned in the combustion zone flows generally in a second direction opposite to the first direction, wherein upon the air reaching a head end of the combustor assembly at an end of the air flow passageway the air turns 180 degrees to flow generally in the first direction into the combustion zone where the air is burned with the fuel;

an inlet assembly positioned radially between the liner and the flow sleeve, the inlet assembly defining an inlet to the air flow passageway and comprising a plurality of overlapping conduits that are arranged such that the air entering the air flow passageway passes through radial spaces between adjacent conduits; and wherein the number of conduits, radial heights between adjacent conduits, and lengths of conduits overlap are each selected to fine tune acoustic losses provided by the inlet assembly.

2. The combustor assembly of claim 1, wherein the conduits are arranged in an axially staggered pattern such that an axial end of each conduit extends further axially toward the turbine section than an axial end of each conduit located radially outward from the respective conduit.

3. The combustor assembly of claim 1, wherein the conduits are concentric with one another.

4. The combustor assembly of claim 1, wherein the conduits are coupled together.

5. The combustor assembly of claim 4, wherein at least one of the conduits is corrugated and outer peaks of the at least one corrugated conduit contact the adjacent radially outer conduit and inner peaks of the at least one corrugated conduit contact the adjacent radially inner conduit.

6. The combustor assembly of claim 4, wherein the inlet assembly further comprises a plurality of radial struts that span between the conduits to couple the conduits together.

7. The combustor assembly of claim 1, wherein an axial end of each of the conduits extends axially further toward the turbine section than an axial end of the flow sleeve.

8. The combustor assembly of claim 1, wherein an entirety of a radially inner one of the conduits is located directly radially outwardly from the liner.

9. The combustor assembly of claim 1, wherein at least one of the conduits is angled in a direction away from the flow sleeve and extends axially away from the turbine section, such that the air flowing through the inlet assembly flows in a direction having a radially inward component and provides localized cooling for combustor assembly components located in and around the air flow passageway.

10. The combustor assembly of claim 1, wherein the inlet assembly comprises at least three conduits.

11. A combustor assembly in a gas turbine engine comprising:

a liner defining a combustion zone where fuel and air are mixed and burned to create a hot working gas that flows through the combustion zone generally in a first direction toward a turbine section of the engine;

at least one fuel injector for providing the fuel to be burned in the combustion zone;

a flow sleeve located radially outwardly from the liner, wherein an inner surface of the flow sleeve defines an outer boundary for an air flow passageway where the air to be burned in the combustion zone flows generally in a second direction opposite to the first direction, wherein upon the air reaching a head end of the combustor assembly at an end of the air flow passageway the air turns 180 degrees to flow generally in the first direction into the combustion zone where the air is burned with the fuel;

an inlet assembly positioned radially between the liner and the flow sleeve, the inlet assembly defining an inlet to the air flow passageway and comprising a plurality of overlapping concentric conduits that are coupled together and are arranged such that the air entering the air flow passageway passes through radial spaces between adjacent conduits; and wherein the number of conduits, radial heights between adjacent conduits, and lengths of conduits overlap are each selected to fine tune acoustic losses provided by the inlet assembly.

12. The combustor assembly of claim 11, wherein the conduits are arranged in an axially staggered pattern such that an axial end of each conduit extends further axially toward the turbine section than an axial end of each conduit located radially outward from the respective conduit.

13. The combustor assembly of claim 11, wherein at least one of the conduits is corrugated and outer peaks of the at least one corrugated conduit contact the adjacent radially outer conduit and inner peaks of the at least one corrugated conduit contact the adjacent radially inner conduit.

14. The combustor assembly of claim 11, wherein the inlet assembly further comprises a plurality of radial struts that span between the conduits to couple the conduits together.

15. The combustor assembly of claim 11, wherein an axial end of each of the conduits extends axially further toward the turbine section than an axial end of the flow sleeve.

16. The combustor assembly of claim 15, wherein an entirety of a radially inner one of the conduits is disposed directly radially outwardly from the liner.

17. The combustor assembly of claim 11, wherein at least one of the conduits is angled in a direction away from the flow sleeve and extends axially away from the turbine section, such that the air flowing through the inlet assembly flows in a direction having a radially inward component and provides localized cooling for combustor assembly components located in and around the air flow passageway.

18. The combustor assembly of claim 11, wherein the inlet assembly comprises at least three conduits.

* * * * *